US006594936B1

(12) United States Patent
Sniezak et al.

(10) Patent No.: US 6,594,936 B1
(45) Date of Patent: Jul. 22, 2003

(54) METHOD FOR LINING A GUN BARREL

(76) Inventors: Gary Sniezak, 3708 Heyward St., Columbia, SC (US) 29205; Kyriakos Christou, 207 Weddell St., Apt. 1G, Columbia, SC (US) 29223

( * ) Notice: Subject to any disclaimer, the term of this patent is extended or adjusted under 35 U.S.C. 154(b) by 0 days.

(21) Appl. No.: 10/263,827

(22) Filed: Oct. 3, 2002

(51) Int. Cl.[7] ..... F41A 21/04
(52) U.S. Cl. ..... 42/76.02; 89/14.7
(58) Field of Search ..... 42/76.02, 78, 76.1; 89/14.7, 16

(56) References Cited

U.S. PATENT DOCUMENTS 4,075,926 A * 2/1978 Eriksson et al. ..... 89/16
4,577,431 A * 3/1986 Siemers et al. ..... 42/76.02
4,769,938 A * 9/1988 Chesnut et al. ..... 42/76.02
5,212,328 A * 5/1993 Petrovich ..... 42/76.02
5,915,937 A * 6/1999 Christensen ..... 42/76.02
6,189,431 B1 * 2/2001 Danner et al. ..... 89/16
6,352,740 B1 * 3/2002 Warnecke ..... 427/11

* cited by examiner

*Primary Examiner*—Michael J. Carone
*Assistant Examiner*—Troy Chambers
(74) *Attorney, Agent, or Firm*—Michael A. Mann; Nexsen Pruet Jacobs & Pollard, LLC; William Y. Klett

(57) ABSTRACT

A method for lining a gun barrel with a material selected to reduce the rate of erosion and corrosion from the rounds of ammunition fired through it includes the steps of forming a rod of the lining material, hammer -forging a barrel blank to the rod, and then drilling out a bore in the rod. The liner extends from the muzzle end of the barrel almost to the chamber end but stops short to abut a step formed in the barrel just forward of the chamber. The chamber is machined, reamed, and chrome-plated. Preferably measures are taken, such as by applying pressure to the rod during forging, to assure that the rod is placed in full engagement with the step and held in full engagement with the step in order to avoid the formation of a gap between the liner and the step.

20 Claims, 2 Drawing Sheets

METHOD FOR LINING A GUN BARREL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

A gun barrel is subjected to significant forces when a bullet is fired through it. The exploding powder in the shell casing drives the bullet from the shell casing and accelerates it through the barrel. Incrementally with each round of ammunition, the barrel is subjected to erosive action toward the chamber end and abrasive action toward the muzzle end. Repeated rounds fired through the barrel eventually take their toll and the accuracy of the gun begins to decline.

Barrels can be made of more exotic materials to address this problem. These materials extend the life of the barrels but with a corresponding increase in cost, perhaps to prohibitive levels for any production gun. Alternatively, there have been a number of attempts to apply coatings to barrels or to insert liners to improve gun barrel durability. These attempts have met with varying degrees of success. The lining material, for example, being very hard, is typically brittle. It is therefore prone to developing cracks as a result of the insertion process.

Thus, there remains a need for a way to provide a durable and cost-effective barrel for a production-quantity gun intended for use in firing large numbers of rounds of ammunition.

SUMMARY OF THE INVENTION

The present invention is a method for lining a barrel. In particular, the present method applies best to those production level gun barrels intended for use in firing large numbers of rounds, such as machine guns. According to this method, a solid rod, or at most a solid rod with a small hole formed in it, made of a suitable liner material, is inserted into a barrel blank. The blank is then forged to the rod. Once forged, the rod is drilled to form the gun bore and rifled. The rod does not extend all the way through the barrel blank but only part way, beginning at the muzzle end and stopping at a "step" formed inside the barrel blank near its chamber end.

Several aspects of this process are important. The first is that the surface of the rod is preferablyroughened or knurled to assure fusing of the blank metal into the metal liner. This ensures structural integrity of the assembly during firing. In addition, pressure is applied to the rod so that it maintains its seat against the step formed inside the barrel blank during forging. This pressure, along with the knurled surface of the rod, helps to maintain the correct position of the rod in the barrel during forging. These measures also help to assure that there is no gap between the liner and the barrel seat.

The location of the step inside the barrel is also important. It is preferably located adjacent to the location where a shell casing would be, if fully seated in the chamber, so that the step is covered by the shell casing, but not located so far toward the chamber end that the liner must be machined as part of the chamber. Also the step is located behind the shell case lip to ensure that hot gases do not flow onto the blank metal, but only onto the liner metal.

Another important part of the process is to begin with a solid or nearly solid rod of liner material. A nearly solid or completely solid rod distributes the stresses of forging better than a tube and results in greatly reduced cracking. To facilitate bore formation, a small holed can be formed in the liner before insertion or after forging, and does detract from the ability of the rest of the rod to distribute stresses.

These and other features and their advantages will be apparent to those skilled in the art of gun barrel manufacture from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

The present invention is a method for lining a gun barrel. The lining is intended to improve the durability of the barrel by making it more resistive to the erosion and corrosion that result from the firing of ammunition through it. This invention is useful in military weaponry, especially machine guns, because of the large number of rounds that are fired through a machine gun barrel and the need to manufacture machine guns in production quantities. The present method can be practiced with a wide variety of gun barrel types so the specific dimensions and surface features of the exteriors of the barrels of different types of guns are not part of the present invention. Furthermore, because any gun lined according to the present invention would be expected to fire the same type of ammunition as before, the interior dimensions of the barrel with a liner incorporated according to the present invention would of course have to be the same as the interior dimensions of a barrel without the liner for the same gun and type of ammunition.

Figure 1:
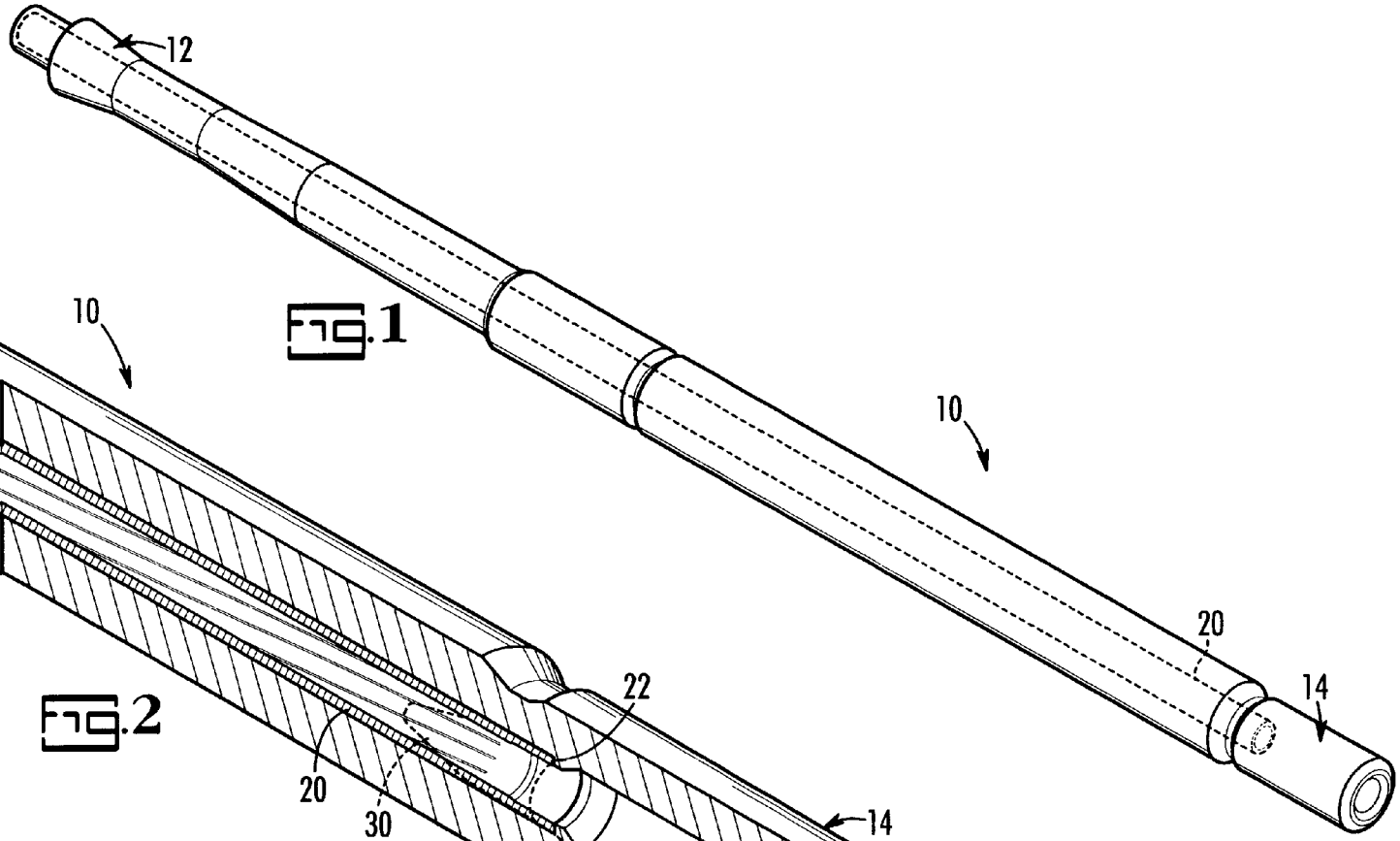
FIG. 1 is a perspective view of a gun barrel.
Figure 2:
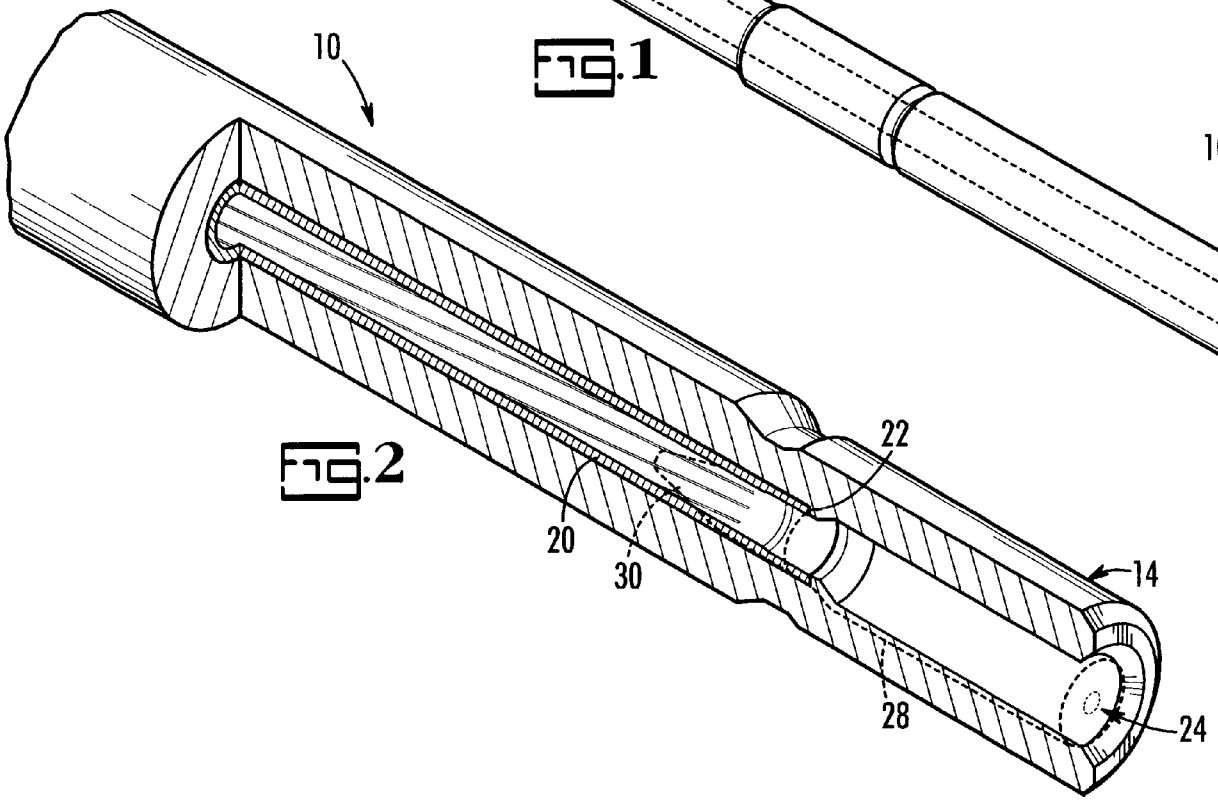
FIG. 2 is a cross sectional view of the chamber end of a gun barrel having a liner according to a preferred embodiment of the present invention.
Figure 3:
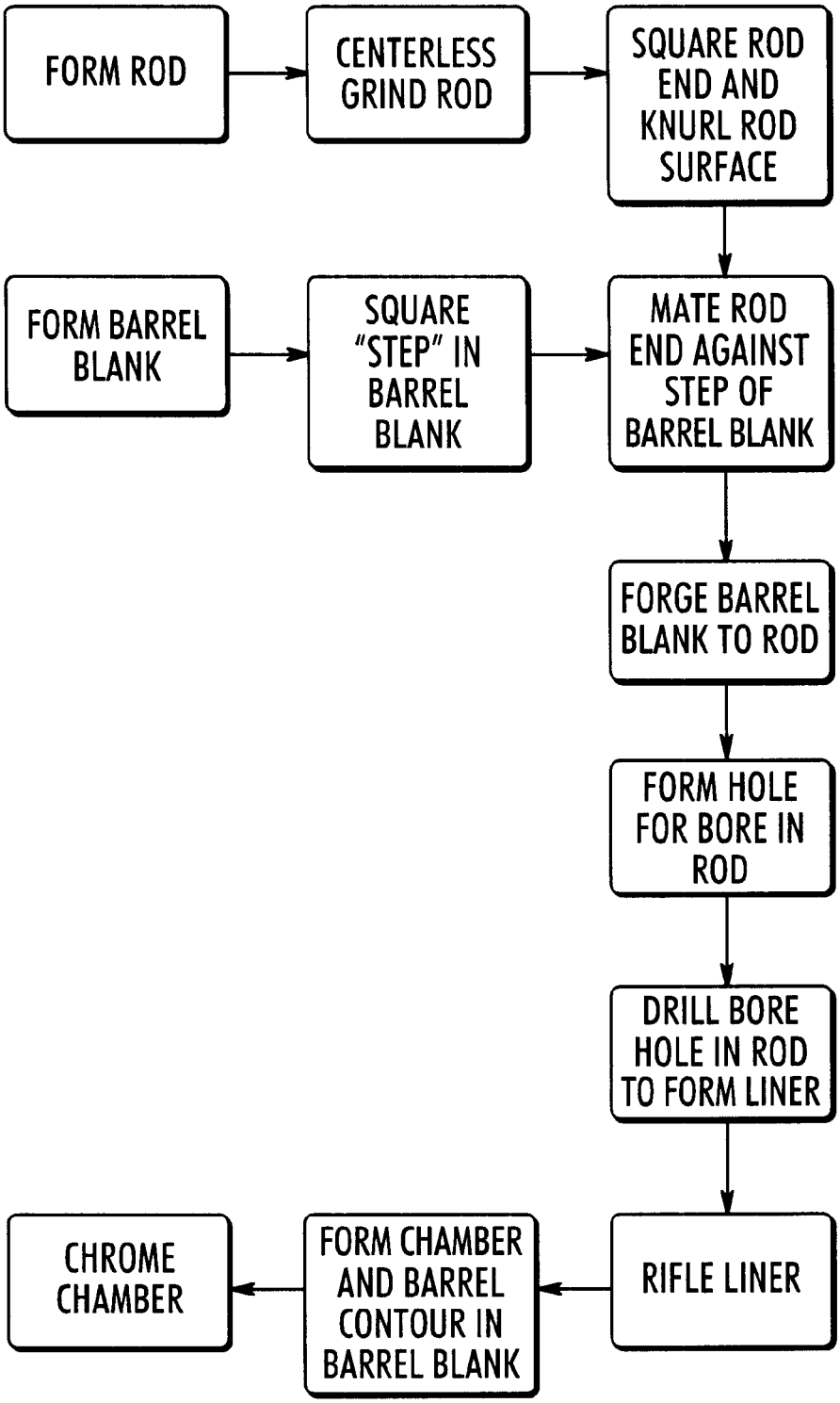
FIG. 3 is a flow chart of a process for lining a gun barrel according to a preferred embodiment of the present invention.

Referring now to the figures, FIG. 1 illustrates a barrel 10 for an M-249 machine gun, which would be a typical application for the present invention. Barrel 10 has a muzzle end 12 and an opposing chamber end 14. FIG. 1 also shows that the present method does not affect the external appearance or dimensions. FIG. 2 illustrates a cross section of a detail of barrel 10, namely chamber end 14, which reveals a liner 20 inside barrel 10.

Liner 20 has a uniform cross section and runs from muzzle end 12 nearly the full length of barrel 10 toward chamber end 14 but stops short of a chamber 24 formed in chamber end 14 where a "step" 22 is formed. Step 22 is a step change in interior diameter from the slightly larger bore beyond toward muzzle end 12, to the slightly smaller bore toward chamber end 14. The end of liner 20 engages the face of step 22.

The existence and location of step 22 is important. By not lining chamber 24, the difficulties of machining the hard material of which liner 20 is made are avoided. Therefore, rather than extend liner 20 all the way to the end of chamber end 14, liner 20 stops short of chamber 24, at step 22. However, liner 20 must extend at least far enough to be effective against the combustion gases and heat from a detonated round of ammunition. Therefore, step 22 is located at a position partway along a shell casing 28 of a round of ammunition 30 if one were fully seated in chamber 24. At this location, the lined portion of barrel 10 is exposed to combustion gases and heat from the detonated round, but the unlined chamber end 14 is protected by shell casing 28. However, use of step 22 to avoid the difficulties of machining chamber 24 dictates that measures be taken when lining barrel 10 to avoid the formation of a gap between step 22 and liner 20. These measures will be described below.

To line barrel 10, a rod is made of a material that resists wear and corrosion, preferably cobalt-based steel alloys such as that manufactured by Stoody-Deloro Stellite, Inc., and sold under the trademark STELLITE. The rod is in the form of a right cylinder; that is, it has a uniform, circular cross section and flat ends lying in a plane perpendicular to the axis of symmetry of the rod. To obtain a rod of suitable dimensions, a rod is cast to approximate dimensions and then machined, preferably by electro-discharge machining. The rod is then ground on a center-less grinding wheel and the ends squared off. Although the rod is preferably solid, it may be formed with a small hole in it. However, the diameter of the hole is preferably smaller than the wall thickness of the rod with the hole. The solid rod or rod with the small hole will absorb, and better distribute, the stresses of hammer forging than a sleeve of the same material. A sleeve is distinct from a rod with a hole in it in the following way. The sleeve wall thickness is small compared to the diameter of the hold formed in it, whereas the rod with the hole has a wall thickness larger than the diameter of the hole. Also, if a sleeve is used, it generally has a hole that is substantially the same size as the required bore of the barrel, requiring perhaps only very small changes in dimensions for plating or polishing. In the present case, as will be described below, the hole will have to be drilled to form the bore.

The surface of the rod, other than the end faces, is then roughened, by knurling for example. Knurling will help to assure that the rod will form a tight interface with the inside diameter of the barrel.

A blank barrel is formed, an oversize bore is drilled therein, and step 22 is formed in the process of drilling. The width of the step is approximately equal to the thickness of the liner. The face of step 22 is squared off, and the roughened rod is inserted. It is important to assure that the rod fully engages step 22 and leaves no gap. Various techniques can be used to verify full engagement of rod and step, and the proper location of the step, such as by X-raying or by the use of a marking ink on the end of the rod that, when the rod is rotated slightly, will rub off where it engages the step. The marking ink will be nibbed off completely if there is complete engagement of rod and step 22.

After the full contact engagement of the end of the rod with the face of the step is obtained, pressure is applied to the rod while the blank barrel is forged to the rod. Preferably, the barrel is hammer-forged. The pressure is applied in order to assure that the rod continues to maintain contact with step 22 and does not slip out of engagement from step 22 during forging.

Next, a small hole is formed, unless already formed by casting in the rod prior to forging to facilitate forming the bore. The small hole can be formed by electro-chemical drilling, or it can be formed when the rod is cast. Then the rod is drilled out to form the bore and the inside surface of the resulting bore is honed to size and rifled, that is, rifling grooves are cut into the inside surface. Preferably this process is achieved using electro-chemical machining.

The liner is at this point complete. The barrel is then machined to the desired contours, including the machining and reaming of chamber 24. Chamber 24 is plated with chrome as a final step.

It will be apparent to those skilled in the art of manufacturing gun barrels that many substitutions and modifications can be made to the foregoing preferred embodiment without departing from the spirit and scope of the present invention, which is defined by the appended claims.

What is claimed is:

1. A method for lining a gun barrel, said method comprising the steps of:

providing a barrel blank, said barrel blank being hollow and having a muzzle end and a chamber end;

providing a rod of liner material;

forming a step inside said hollow barrel blank, said step facing said muzzle end of said barrel;

inserting said rod into said hollow barrel blank from said muzzle end, said rod being placed in engagement with said step during insertion of said rod into said hollow barrel blank applying pressure to said rod during said forging so that said rod remains in engagement with said step;

forging said barrel blank to said rod; and drilling a bore in said rod to form said gun barrel.

2. The method as recited in claim 1, further comprising the step of forming a hole in said rod prior to drilling said bore.

3. The method as recited in claim 1, further comprising the steps of:

forming a step inside said hollow barrel blank, said rod being placed in engagement with said step during insertion of said rod into said hollow barrel blank; and applying pressure to said rod during said forging so that said rod remains in engagement with said step.

4. The method as recited in claim 3, wherein said step is formed near said chamber end.

5. The method as recited in claim 4, further comprising the step of machining a chamber in said chamber end of said barrel blank after said drilling step.

6. The method as recited in claim 3, wherein said step is formed adjacent to the location of a shell casing of a round of ammunition when said round of ammunition would be fully seated in said chamber end.

7. The method as recited in claim 1, wherein said liner material is a cobalt-based steel alloy.

8. The method as recited in claim 3, further comprising the step of verifying said rod is in engagement with said step.

9. A method for lining a gun barrel, said method comprising the steps of:

providing a barrel blank, said barrel blank being hollow and having a muzzle end and an opposing chamber end;

forming a step in said barrel blank proximate to said chamber end and facing said muzzle end;

providing a rod of liner material;

inserting said rod into said hollow barrel blank so that said rod is in engagement with said step;

forging said barrel blank to said rod;

drilling a bore in said rod; and machining said chamber in said chamber end to form said gun barrel.

10. The method as recited in claim 9, wherein said rod has an exterior surface, said method further comprising the step of roughening said exterior surface of said rod prior to inserting said rod into said barrel blank.

11. The method as recited in claim 9, wherein said rod has an exterior surface, said method further comprising the step of knurling said exterior surface of said rod prior to inserting said rod into said barrel blank.

12. The method as recited in claim 9, further comprising the step of forming a hole in said rod prior to inserting said rod into said barrel blank.

13. The method as recited in claim 12, wherein said hole formed in said rod defines a rod wall thickness, and wherein said hole has a diameter smaller than said wall thickness.

14. The method as recited in claim 9, further comprising the step of applying pressure to said rod to hold said rod in engagement with said step during forging.

15. The method as recited in claim 9, wherein said step is formed adjacent to the location of a shell casing of a round of ammunition when said round of ammunition would be fully seated in said chamber end.

16. The method as recited in claim 9, further comprising the step of forming rifling inside said bore.

17. The method as recited in claim 9, further comprising the step of chrome plating said chamber.

18. The method as recited in claim 9, wherein said liner material is a cobalt-based steel alloy.

19. The method as recited in claim 9, further comprising the step of verifying said rod is in engagement with said step after inserting said rod into said barrel blank.

20. The method as recited in claim 9, wherein said step is formed forward of said chamber.

* * * * *